US006082962A

United States Patent [19]

Drosdziok et al.

[11] Patent Number: 6,082,962

[45] Date of Patent: Jul. 4, 2000

[54] TURBINE SHAFT AND METHOD FOR COOLING A TURBINE SHAFT

[75] Inventors: Armin Drosdziok, Essen; Axel Remberg; Ernst-Erich Mühle, both of Mülheim an der Ruhr, all of Germany

[73] Assignee: Siemens Aktiengesellschaft, Munich, Germany

[21] Appl. No.: 09/198,218

[22] Filed: Nov. 23, 1998

Related U.S. Application Data

[63] Continuation of application No. PCT/DE97/00970, May 14, 1997.

[30] Foreign Application Priority Data

May 23, 1996 [DE] Germany ..... 196 20 828

[51] Int. Cl.[7] ..... F01D 5/14; F03B 11/00; F04D 29/58

[52] U.S. Cl. ..... 415/115; 415/180

[58] Field of Search ..... 415/93, 101, 102, 415/103, 115, 176, 180

[56] References Cited

U.S. PATENT DOCUMENTS

| | | | |
|---|---|---|---|
| 3,291,447 | 12/1966 | Brandon . | |
| 3,817,654 | 6/1974 | Sohma | 415/103 |
| 4,465,429 | 8/1984 | Martin et al. . | |
| 4,571,153 | 2/1986 | Keller | 415/103 X |
| 5,232,338 | 8/1993 | Vincent De Paul et al. | 415/115 X |

FOREIGN PATENT DOCUMENTS

| | | | |
|---|---|---|---|
| 32 09 506 A1 | 9/1983 | Germany . | |
| 34 06 071 A1 | 8/1984 | Germany . | |
| 58-101201 | 6/1983 | Japan | 415/103 |
| 133 001 | 7/1929 | Sweden . | |
| 341940 | 12/1959 | Switzerland | 415/102 |

OTHER PUBLICATIONS

Patent Abstracts of Japan No. 59–155503 (Tadashi), dated Sep. 4, 1984.

"Measurements for modernizing and prolong the life of steam turbine components" (Bergmann et al.), VGB Power Engineering, vol. 71, No. 2, pp. 116–122.

Patent Abstracts of Japan No. 60–159304 (Minoru), dated Aug. 20, 1985.

Patent Abstracts of Japan No. 58–133402 (Shinichiro), dated Aug. 9, 1983.

*Primary Examiner*—John E. Ryznic

*Attorney, Agent, or Firm*—Herbert L. Lerner; Laurence A. Greenberg; Werner H. Stemer

[57] ABSTRACT

A turbine shaft includes an inflow region for fluid, in particular steam, and at least two recesses spaced apart axially from one another and from the inflow region, for receiving at least one turbine blade in each case. A cavity in the turbine shaft is associated with the inflow region and is connected to a feed line and a discharge line for fluid for cooling the turbine shaft. A steam turbine and a method for cooling an inflow region of a turbine shaft disposed in a steam turbine, are also described.

14 Claims, 2 Drawing Sheets

TURBINE SHAFT AND METHOD FOR COOLING A TURBINE SHAFT

CROSS-REFERENCE TO RELATED APPLICATION

This application is a continuation of copending International Application No. PCT/DE97/00970, filed on May 14, 1997, which designated the United States.

BACKGROUND OF THE INVENTION

Field of the Invention

The invention relates to a turbine shaft which is aligned along a principal axis and includes an inflow region for fluid, and at least two mutually spaced recesses adjoining the inflow region in axial direction for receiving at least one turbine blade in each case. The invention furthermore relates to a steam turbine and a method for cooling an inflow region of a turbine shaft disposed in a turbine, in particular a steam turbine.

German Published, Non-Prosecuted Patent Application DE 32 09 506 A1, corresponding to U.S. Pat. No. 4,571,153, relates to an axial-flow steam turbine, especially one of double-flow construction. In a steam inflow region, an annular passage is formed between the shaft and an annular shaft shield. The shaft has a rotationally symmetrical depression in the steam inflow region. The annular shaft shield projects partially into the depression and is connected to the casing of the turbine through first fixed-blade rows and supported thereby. The shaft shield has conduits for the purpose of introducing steam. The conduits are disposed centrally with respect to the inflow region, between the first fixed blades and they open tangentially into a gap between the rotating shaft and the fixed shield supported by the casing.

German Published, Non-Prosecuted Patent Application DE 34 06 071 A1 discloses an annular shaft shield which is disposed between two rings of the first fixed-blade rows. The shaft shield shields the outer periphery or surface of the turbine shaft from the live steam. The shaft shield has inlets upstream of the rings through which a partial stream of the live steam passes in a restricted manner into a gap between the shaft shield and the turbine shaft. The inlets are angled in such a way that the live steam has a flow component imparted to it in the circumferential direction of the turbine shaft. Auxiliary fixed blades and auxiliary rotating blades can be respectively provided on the inner periphery of the shaft shield and the turbine shaft.

The use of steam at relatively high pressures and temperatures, especially in what are referred to as supercritical steam conditions, with a temperature of, for example, above 550° C., contribute to an increase in the efficiency of a steam turbine. The use of steam in such a condition makes increased demands on a steam turbine that is acted upon in a corresponding manner, particularly on the turbine shaft of the steam turbine.

Patent Abstracts of Japan Publication No. JP 58/133402 describes a double-flow steam turbine which is provided with a chamber construction. Wheel discs which are mounted on the turbine shaft have turbine blades disposed on their respective outer ends. A cover plate disposed in the intermediate region of the turbine shaft into which the working fluid flows, is held by respective first stationary blade rows. The cover plate, which is disposed at the upper end of the wheel discs, forms a non-sealing end for a spatial region, which on one hand is formed by the sides of the wheel discs and on the other hand by the turbine shaft. The wheel discs defining the spatial region have openings for the inflow of working fluid into the spatial region. The openings are sized differently, so that a vacuum is generated in the spatial region and working fluid can flow into the spatial region at least through one wheel disc.

SUMMARY OF THE INVENTION

It is accordingly an object of the invention to provide a turbine shaft which can be cooled in a region subject to high thermal loading, in particular an inflow region for working fluid, and a method for cooling a turbine shaft disposed in a turbine, particularly of an inflow region of the turbine shaft, which overcome the hereinafore-mentioned disadvantages of the heretofore-known devices and methods of this general type.

With the foregoing and other objects in view there is provided, in accordance with the invention, a turbine shaft, comprising an inflow region for working fluid; turbine blades; a shaft body extending along a principal axis and having a shaft surface; the shaft body having at least two recesses formed therein for receiving at least one of the turbine blades in each of the at least two recesses, the at least two recesses spaced apart axially from one another and from the inflow region, and the at least two recesses including a first recess and another recess downstream of the first recess; the shaft body having a cavity formed therein associated with the inflow region; and a feed line and a discharge line connected to the cavity for conducting a partial stream of the working fluid as cooling fluid, the feed line opening at the shaft surface downstream of the first recess and the discharge line opening at the shaft surface downstream of the other recess.

This structure ensures that both the pressure and the temperature of the working fluid are lower in the region of the second recess than in the region of the first recess. If the working fluid used to drive the turbine shaft is used as the cooling fluid for cooling the turbine shaft, this ensures that a flow through the cavity is established purely by virtue of the temperature and/or pressure gradient. The cavity is preferably rotationally symmetrical with respect to the shaft axis.

The cooling of the material of the shaft brings about a significant increase in the bearing capacity of the material and then permits a more rational construction, e.g. the use of conventional, low-cost materials for the shaft, even in the region of very high steam inlet temperatures.

If the turbine shaft is subjected to working fluid, in particular steam in a supercritical steam condition, cooling of the turbine shaft in the inflow region is achieved by feeding cooling fluid into the cavity. The cooling fluid which is fed to the cavity to cool the turbine shaft can be a partial stream from already cooled working fluid, in particular steam, fed to the turbine shaft in the inflow region. In the cavity, the cooling fluid used for cooling is heated by heat transfer. If the cooling fluid corresponds to the working fluid for operating the turbine in which the turbine shaft is disposed, the cavity represents a reheater. The cooling fluid which undergoes reheating therein can be fed to the turbine, in particular the steam turbine, again at any suitable location (as working fluid) or can be removed from it through the use of an extraction location.

In accordance with another feature of the invention, in the case of a turbine shaft for a double-flow turbine, in particular a medium-pressure steam turbine, the inflow region is preferably disposed along the principal axis, in the central region of the turbine shaft. The inflow region additionally serves to divide the inflowing working fluid which drives the turbine. The cavity is preferably recess-turned in the radial direction and is situated between the respective first rotating blade rows in the axial direction.

In accordance with a further feature of the invention, in the case of a single-flow turbine, the inflow region is situated in an end region of the turbine shaft and the discharge line is passed through the casing, back into the steam flow region, for example, specifically downstream of the first recess. This also ensures a pressure and/or temperature difference between the inlet of the feed line and the outlet of the discharge line.

In accordance with an added feature of the invention, the discharge line likewise leads to an extraction location, allowing the cooling fluid flowing out of the cavity to be removed directly from the steam turbine. The end region is preferably constructed as a piston with an enlarged diameter. This piston has a seal which seals off the steam flow region between the turbine shaft and the casing of the turbine. The cavity is preferably formed between the recess for the first rotating blade row and the piston. The discharge line preferably leads from the cavity into the piston and there emerges in the region of the seal.

In accordance with an additional feature of the invention, the feed line and/or the discharge line have a largely axial bore and a largely radial bore. The radial bore leads from the shaft surface into the turbine shaft and enters the axial bore, which extends from the cavity in the axial direction. The diameters of the feed and discharge lines are each matched to the corresponding steam conditions and the desired cooling. In a corresponding manner, the size of the cavity is matched to the required cooling performance.

In accordance with yet another feature of the invention, the cavity is closed by a cover, in particular a cover which is rotationally symmetrical with respect to the shaft axis, and this cover can simultaneously serve as a flow deflection element. The cover is preferably welded to the turbine shaft, ensuring that cooling fluid and working fluid are kept separate in the inflow region. Flow losses due to mixing are thus avoided. In the cavity, the cooling fluid is not in direct contact with the hot working fluid, in particular steam in a supercritical steam condition, striking the outer surface of the cover. The cover serves as a heat exchanger, so that heat is transferred from the turbine shaft to the cooling fluid both through the cover and through the walls of the cavity.

The turbine shaft with cooling in the inflow region of the hot working fluid is particularly suitable in a steam turbine which is supplied with steam in a supercritical steam condition. The steam turbine can be a double-flow medium-pressure turbine section or a single-flow steam turbine. The steam turbine can be cooled, merely by feeding in live steam behind the first rotating blade row, in such a way that reliable operation of the turbine shaft in the case of steam conditions with temperatures above 550° C. is ensured.

With the objects of the invention in view there is also provided a method for cooling an inflow region of a turbine shaft disposed in a turbine, in particular a steam turbine, which comprises providing a turbine shaft with a shaft surface, an inflow region and a cavity associated with the inflow region; providing rotating blade rows including a first rotating blade row; feeding a partial stream of a working fluid as cooling fluid from the shaft surface downstream of the first rotating blade row at a first pressure level; and guiding the partial stream of the working fluid out of the turbine shaft through a discharge line discharging at the shaft surface at a second pressure level lower than the first.

According to the method of the invention for cooling an inflow region in a turbine, in particular a steam turbine, working fluid, in particular steam in a supercritical steam condition, flows as cooling fluid downstream of a first rotating blade row, into a cavity associated with the inflow region and, from there, is led out from the turbine shaft through a discharge line. Heat is thereby released from the inflowing working fluid, wherein that heat has been released to the turbine shaft through the walls of the cavity to the cooling fluid guided into the cavity, ensuring cooling of the turbine shaft. The partial stream of the working fluid which serves as the cooling fluid is removed at a first pressure level in the inflow region and led out of the turbine shaft at a second pressure level lower than the first pressure level. This cooling can be established in a structurally simple manner by forming a corresponding cavity, for example by recess-turning, with an associated discharge line and feed line. Possible influences due to the formation of the cavity with regard to the thermomechanical properties of the turbine shaft are more than compensated for by the cooling which is carried out. The turbine shaft provided with cooling of the inflow region is therefore also particularly suitable for steam in a supercritical steam condition at temperatures of above 550° C.

In particular, in the case of a double-flow medium-pressure turbine section supplied with steam, the cooling fluid is led out of the turbine shaft downstream of a second rotating blade row, which is disposed further downstream than the first rotating blade row. Since there is a pressure and/or temperature gradient between the inflow into the feed line and the outflow from the discharge line, the flow of the cooling fluid through the cavity is maintained without measures to enforce it in the case of a single-flow turbine, in particular a medium-pressure turbine section. The cooling fluid is guided out of the cavity, through an end region of the turbine shaft, through the discharge line into the casing surrounding the turbine shaft. In this case, the cooling fluid can be introduced directly into an extraction location or (as working fluid) back into the steam flow, between the casing and the turbine shaft, downstream of a fixed-blade row further downstream than the first rotating blade row. The partial stream removed from the stream of steam driving the turbine shaft is thus made available again, so that, at worst, the effect on the efficiency of the turbine is slight. Since, in addition, the cooling fluid flowing into the cavity is heated up, with the cavity thus acting as a reheater, it may even be possible to achieve an increase in efficiency.

In accordance with a concomitant mode of the invention, the cavity is supplied with a volume flow of steam of 1% to 4%, in particular 1.5 to 3%, of the total volume flow of live steam driving the turbine shaft. The quantity of steam supplied and serving for cooling depends on individual parameters, such as steam conditions, the materials used and the power rating of the steam turbine system.

Other features which are considered as characteristic for the invention are set forth in the appended claims.

Although the invention is illustrated and described herein as embodied in a turbine shaft and a method for cooling a turbine shaft, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
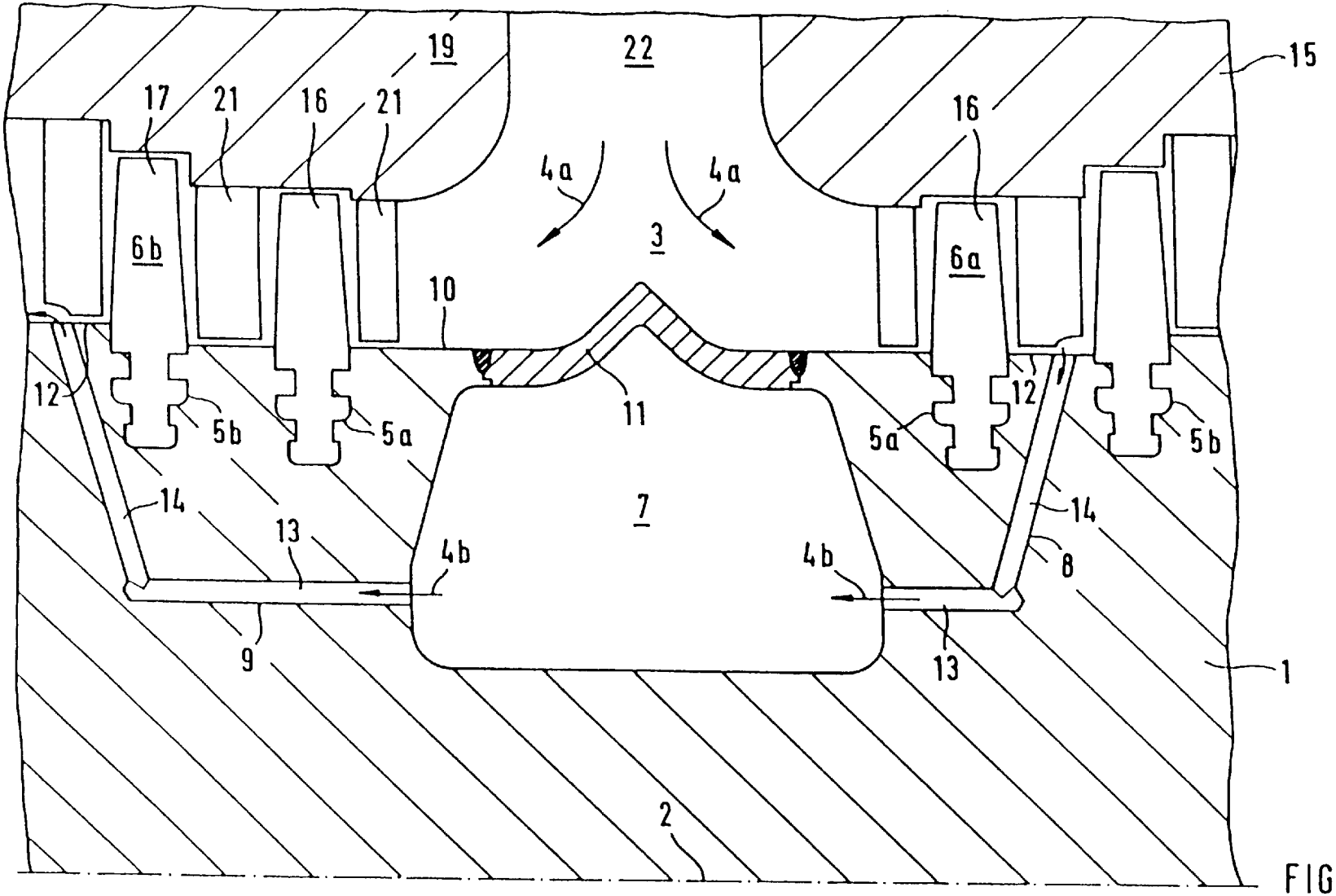
FIG. 1 is a fragmentary, diagrammatic, longitudinal-sectional view of a double-flow medium-pressure turbine section.

Referring now in detail to the figures of the drawings, in which identical reference symbols have the same meaning, and first, particularly, to FIG. 1 thereof, there is seen a portion of a longitudinal section through a double-flow medium-pressure turbine section 15 of a steam-turbine system. A turbine shaft 1 is disposed in a casing 19. The turbine shaft 1 has a shaft body which extends along a principal axis 2 and has a central region 10 with an inflow region 3 for working fluid 4*a*, in particular steam in a supercritical condition. The casing 19 has a steam inlet 22 associated with the inflow region 3, so that steam flows in between the casing 19 and the turbine shaft 1. The steam is divided into two partial streams in the inflow region 3, as is indicated by flow arrows. The steam turbine 15 has a cavity 7 which is preferably produced by recess-turning and is disposed in the central region 10. The cavity 7 has a side facing the steam inlet 22, which is closed by a cover 11 that is welded to the turbine shaft 1. The cover 11 is arched in the direction of the steam inlet 22, thereby assisting the division of the steam 4*a* into two partial steam streams. The body of the turbine shaft 1 has recesses 5*a* and 5*b* which adjoin the inflow region 3 in the axial direction and are each spaced apart from one another. These recesses 5*a*, 5*b* serve to receive turbine blades 6*a*, 6*b* forming respective rows 16 and 17 of rotating blades. For the sake of clarity, further recesses and rotating blades disposed therein are not shown. A stationary blade row 21 is provided on the casing 19, in front of each corresponding rotating blade row 16, 17.

An essentially radial bore 14 leading into the interior of the body of the turbine shaft 1 is disposed downstream of the first recess 5*a* and associated with the partial stream of steam flowing towards the right in FIG. 1. This bore 14 enters an axial bore 13 which opens into the cavity 7. The two bores 14 and 13 form a feed line 8 which connects a surface 12 of the shaft body to the cavity 7 in terms of flow. As a result, part of the steam 4*a* passes into the cavity 7 downstream of the first rotating blade row 16 in accordance with the flow arrows. A further axial bore 13 leads from the cavity 7 into the body of the turbine shaft 1 on that side of the cavity 7 which lies opposite the feed line 8. This axial bore 13 enters an essentially radial bore 14 which discharges at the shaft surface 12 downstream of the second recess 5*b*. The latter two bores 13 and 14 form a discharge line 9 through which steam 4*b* is led back out of the cavity 7 into the partial stream 4*a* of steam deflected to the left in FIG. 1.

The steam 4*b*, which serves as a cooling fluid, undergoes reheating in the cavity 7 which is closed off by the cover 11, making it possible to achieve not only cooling of the turbine shaft 1 but also, potentially, an increase in the efficiency of the steam turbine 15. The volume flow of steam 4*b* guided through the feed line 8, the cavity 7 and the discharge line 9 depends on the amount of heat to be dissipated, the power rating of the steam turbine 15 and other parameters. It can be between 1.5% and 3.0% of the total volume flow of live steam. In order to avoid the turbine blades 6*a*, 6*b* disposed to the left and right of the inflow region from being acted upon asymmetrically as a result of the flow of steam through the cavity 7, the total stream of live steam may be divided in a suitable manner into two approximately equal partial streams flowing to the left and to the right. The cooling of the turbine shaft 1 in the inflow region 3 improves its thermomechanical properties and ensures the ability of the turbine shaft 1 to endure even in the case of high-temperature loading of above 550° C.

Figure 2:
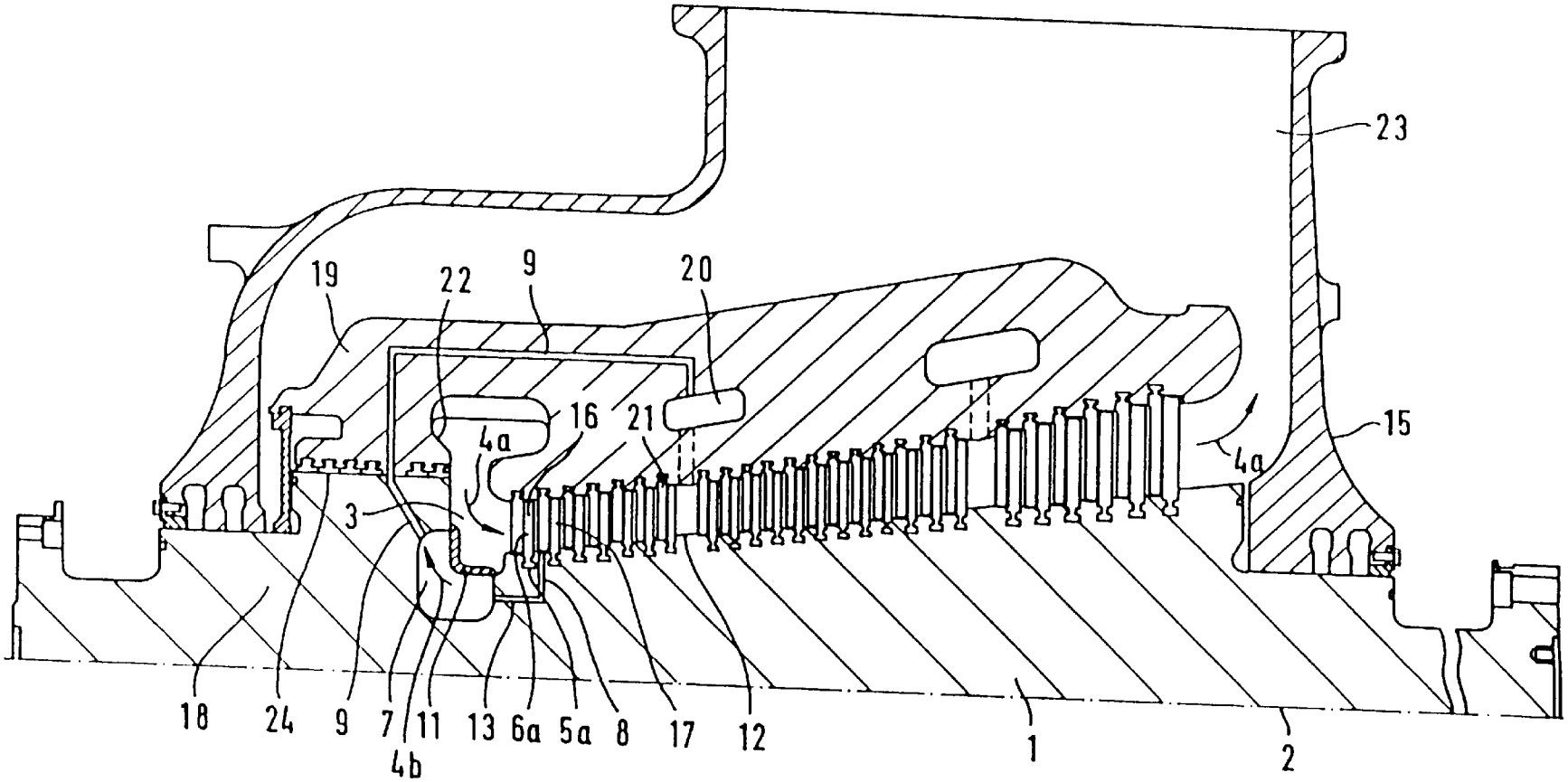
FIG. 2 is a longitudinal-sectional view of a single-flow medium-pressure steam turbine.

FIG. 2 shows a longitudinal section of a single-flow medium-pressure steam turbine 15, although only a part above a principal axis 2 is shown for reasons of clarity. The steam turbine 15 has a casing 19, in which a turbine shaft 1 having a body extending along the principal axis 2 is shown. The turbine shaft 1 is sealed off relative to the casing 19 in an end region 18, through the use of a shaft seal 24. The steam 4*a* for driving the turbine shaft 1 is fed to the steam turbine 15 through a steam inlet 22 and flows essentially along the principal axis 2 through alternately disposed rotating blade rows 16, 17 and fixed-blade rows 21 to an outflow nozzle 23. An inflow region 3 which adjoins the steam inlet 22 lies between the end region 18 and the first rotating blade row 16. In this inflow region 3, the body of the turbine shaft 1 has a cavity 7, which is closed relative to the inflow region 3 by a cover 11. A feed line 8 downstream of the first rotating blade row 16 leads through the body of the turbine shaft 1 to the cavity 7. A discharge line 9 leads from this cavity 7 through the body of the turbine shaft 1 to the shaft seal 24, and from there through the casing 19 to an extraction location 20. There is a temperature and/or pressure difference between the first rotating blade row 16 and the extraction location 20, with the result that steam 4*b* flows through the feed line 8 into the cavity 7, and from there through the discharge line 9 to the extraction location 20 without additional measures for enforcing this flow. This steam 4*b* absorbs heat from the turbine shaft 1 through walls, in particular the cover 11, and thus effects cooling of the turbine shaft 1. Due to the absorption of the heat, the steam 4*b* in the cavity 7 undergoes reheating and can thus continue to be used for the entire steam process, possibly improving efficiency. The feedline 8 and the discharge line 9 can be constructed in a structurally simple manner as bores.

The invention is distinguished by a turbine shaft which has a cavity to which fluid can be fed for cooling, wherein the cavity is disposed in an inflow region subjected to high thermal loading. The cooling fluid fed to the cavity is preferably branched off from the total stream of steam or gas driving the turbine shaft. Continuous flow through the cavity is ensured by connecting the cavity, in terms of flow, to regions in which different pressure and/or temperature conditions of the steam or of the gas prevail. This is brought about without additional compulsory measures. Heat transfer from the turbine shaft to the fluid used for cooling, in particular steam, takes place through the walls of the cavity, as a result of which reliable cooling of the turbine shaft and reheating of the cooling fluid are accomplished.

We claim:

1. A turbine shaft, comprising:

an inflow region for working fluid;

turbine blades;

a shaft body extending along a principal axis and having a shaft surface;

said shaft body having at least two recesses formed therein for receiving at least one of said turbine blades in each of said at least two recesses, said at least two recesses spaced apart axially from one another and from said inflow region, and said at least two recesses including a first recess and another recess downstream of said first recess;

said shaft body having a cavity formed therein associated with said inflow region; and a feed line and a discharge line connected to said cavity for conducting a partial stream of the working fluid as cooling fluid, said feed line opening at said shaft surface downstream of said first recess and said discharge line opening at said shaft surface downstream of said other recess.

2. The turbine shaft according to claim 1, wherein said shaft body has a central region, and said inflow region is disposed in said central region for division of a fluid stream in direction of said principal axis.

3. The turbine shaft according to claim 1, wherein said turbine blades are disposed in a first rotating blade row and a second rotating blade row downstream of said first rotating blade row, said feed line emerges at said shaft surface downstream of said first rotating blade row and said discharge line emerges at said shaft surface downstream of said second rotating blade row.

4. A steam turbine, comprising a turbine shaft according to claim 1.

5. A double-flow medium-pressure turbine section, comprising a turbine shaft according to claim 1.

6. A steam turbine, comprising:

a casing;

turbine blades;

a turbine shaft extending along a principal axis in said casing, said turbine shaft having a shaft surface, an end region and an inflow region for a working fluid, said turbine shaft having at least two recesses formed therein and spaced apart axially from one another and from said inflow region, for receiving at least one of said turbine blades in each of said at least two recesses, said at least two recesses including a first recess and another recess downstream of said first recess, and said turbine shaft having a cavity formed therein associated with said inflow region; and a feed line and a discharge line connected to said cavity for conducting a partial stream of the working fluid as cooling fluid, said feed line opening at said shaft surface downstream of said first recess, and said discharge line guided into said casing through said end region and in said casing as far as a region downstream of said other recess.

7. The steam turbine according to claim 6, including a single flow medium-pressure turbine section in which said casing, said shaft, said turbine blades and said feed and discharge lines are disposed.

8. The steam turbine according to claim 6, wherein said turbine blades are disposed in a first rotating blade row and a second rotating blade row, and said discharge line opens into an extraction location downstream of said first rotating blade row.

9. The steam turbine according to claim 6, including a cover closing said cavity.

10. The steam turbine according to claim 6, wherein at least one of said lines has a largely axial bore and a largely radial bore.

11. A method for cooling an inflow region of a turbine shaft disposed in a turbine, which comprises:

providing a turbine shaft with a shaft surface, an inflow region and a cavity formed within the turbine shaft and associated with the inflow region;

providing rotating blade rows including a first rotating blade row;

feeding a partial stream of a working fluid as cooling fluid from the shaft surface downstream of the first rotating blade row at a first pressure level into the cavity; and guiding the partial stream of the working fluid from the cavity out of the turbine shaft through a discharge line discharging at the shaft surface at a second pressure level lower than the first pressure level.

12. The method according to claim 11, which comprises providing the turbine shaft in a steam turbine.

13. The method according to claim 12, which comprises feeding a volume flow of steam, equal to 1.0% to 4.0% of a total volume flow of live steam, to the cavity as cooling fluid in the steam turbine.

14. The method according to claim 12, which comprises feeding a volume flow of steam, equal to 1.5% to 3% of a total volume flow of live steam, to the cavity as cooling fluid in the steam turbine.

* * * * *